United States Patent [19]

Gardner et al.

[11] Patent Number: 4,522,429

[45] Date of Patent: Jun. 11, 1985

[54] METHOD OF RENDERING DOCUMENTS RESISTANT TO PHOTOCOPYING, AND ANTI-COPYING PAPER AND INK THEREFOR

[75] Inventors: Norman A. Gardner; Michael P. Voticky, both of Montreal, Canada

[73] Assignee: Nocopi Inc., New York, N.Y.

[21] Appl. No.: 443,819

[22] Filed: Nov. 23, 1982

Related U.S. Application Data

[63] Continuation-in-part of Ser. No. 379,674, May 19, 1982, abandoned.

[30] Foreign Application Priority Data

May 25, 1981 [CA] Canada ..... 378239

[51] Int. Cl.[3] ..... B41M 3/14; B42D 15/00

[52] U.S. Cl. ..... 283/91; 162/134; 162/140; 162/162; 283/94; 283/902; 427/7; 427/162; 427/258; 427/265; 427/288; 428/195; 428/201; 428/203; 428/204; 428/207; 428/211; 428/212; 428/537.5; 428/913; 428/916

[58] Field of Search ..... 162/134, 140, 162; 282/27.5; 283/91, 94, 902; 427/7, 150, 151, 152, 153, 162, 256, 258, 265, 288; 428/195, 207, 211, 212, 537, 914, 916, 201, 203, 204, 913, 537.5

[56] References Cited

U.S. PATENT DOCUMENTS 4,118,122 10/1978 Rees et al. ..... 283/902
4,175,776 11/1979 Ranauro ..... 283/902
4,277,514 7/1981 Sugiura et al. ..... 283/91

FOREIGN PATENT DOCUMENTS 2039466A 8/1980 United Kingdom ..... 283/94

*Primary Examiner*—Bruce H. Hess
*Attorney, Agent, or Firm*—Robert F. Delbridge; Arne I. Fors

[57] ABSTRACT

Confidential information is printed, typed or otherwise applied to paper with a color having a reflection spectral response or less than about 10% for light with a wave-length below about 600 millimicrons. The color is sufficiently contrasting with the information to enable the information to be read by the human eye when the document is viewed under white light, but the document cannot be successfully photocopied.

33 Claims, 3 Drawing Figures

Figure 1:
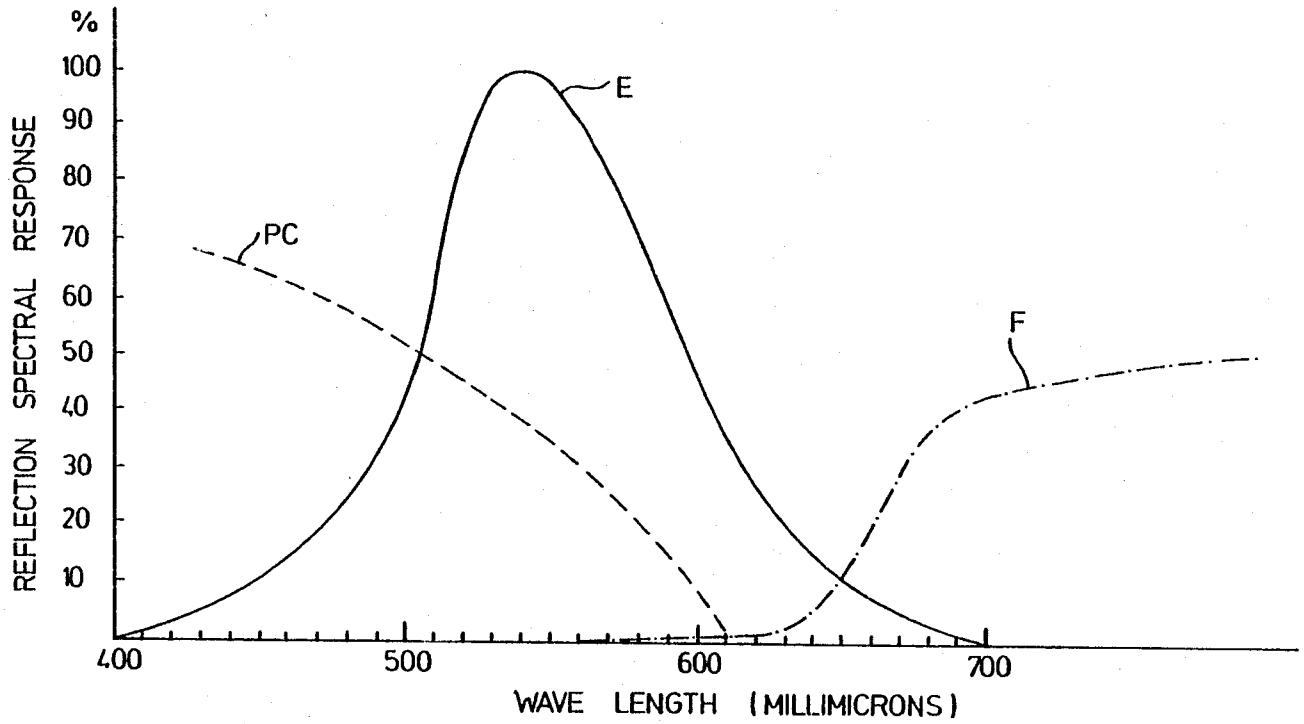

Ro
RR
RB
Bo
%
100
90
80
70
60
50
40
30
20
10
TRANSMISSION SPECTRAL CHARACTERISTIC
480
500
600
700
800
WAVE LENGTH (MILLIMICRONS)

%
100
90
80
70
60
50
40
30
20
10
REFLECTION SPECTRAL RESPONSE
480
500
600
700
800
WAVE LENGTH (MILLIMICRONS)
E
PC
(RR)²
(RB)²

METHOD OF RENDERING DOCUMENTS RESISTANT TO PHOTOCOPYING, AND ANTI-COPYING PAPER AND INK THEREFOR

This application is a continuation-in-part of application Ser. No. 379,674, filed May 19, 1982, now abandoned.

This invention relates to rendering documents resistant to photocopying, and inter alia provides an extremely novel and useful anti-photocopying paper.

The present-day readily availability of photocopiers has given rise to the problem of how to render documents or portions thereof resistant to photocopying. It is now unduly easy for someone to make an unauthorized photocopy of a document carrying confidential information, unless the document is resistant to photocopying. Various attempts have been made to render documents resistant to photocopying by covering information on a document with a transparent film which permits the information to be seen by the human eye but which prevents an adequate photocopy being made. U.S. Pat. Nos. 3,887,742 and 4,118,122 disclose proposals of this kind, but for one reason or another neither of these proposals provide a satisfactory solution to the problem of rendering documents resistant to photocopying.

An object of the invention is to provide improved means for rendering a document or a portion thereof resistant to photocopying.

According to the invention, a document or portion thereof is provided with a colour having a reflection spectral response or less than about 10% for light with a wave-length below about 600 millimicrons and yet which is sufficiently contrasting with the information thereon to enable the information to be read by the human eye when the document is viewed under white light.

It has been found that a document in accordance with the invention is adequately resistant to photocopying by most photocopiers available at the present time, while at the same time the information can be read by the human eye.

Preferably, the colour has a reflection spectral response or less than about 10% for light with a wave-length below about 620 millimicrons, and more preferably below about 650 millimicrons.

The colour may be provided by applying an ink of such a colour over at least a portion of the document, or by providing a document with such a colour during manufacture. This aspect of the invention is especially important since it provides an anti-photocopying paper, that is to say paper upon which information can be printed or otherwise applied and which cannot be photocopied by most photocopiers available at the present day.

Alternatively, the colour may be provided by laying a transparent film of the colour over at least a portion of the document, with the transparent film preferably being adhesively secured thereto.

The transparent film may comprise a plurality of superposed layers. Advantageously, the transparent film comprises a first layer with a transmission spectral response which is less than about 10% at a wave-length at about 600 millimicrons and rises to about 75% at a wave-length of about 650 millimicrons, and a second layer with a transmission spectral response of about 50% for wave-length from about 600 to about 700 millimicrons, the first and second layers providing a reflection spectral response of less than about 10% for light with a wave-length less than about 650 millimicrons.

Also, the colour preferably has a reflection spectral response of substantially zero for light with a wave-length less than about 620 millimicrons.

Figure 2:
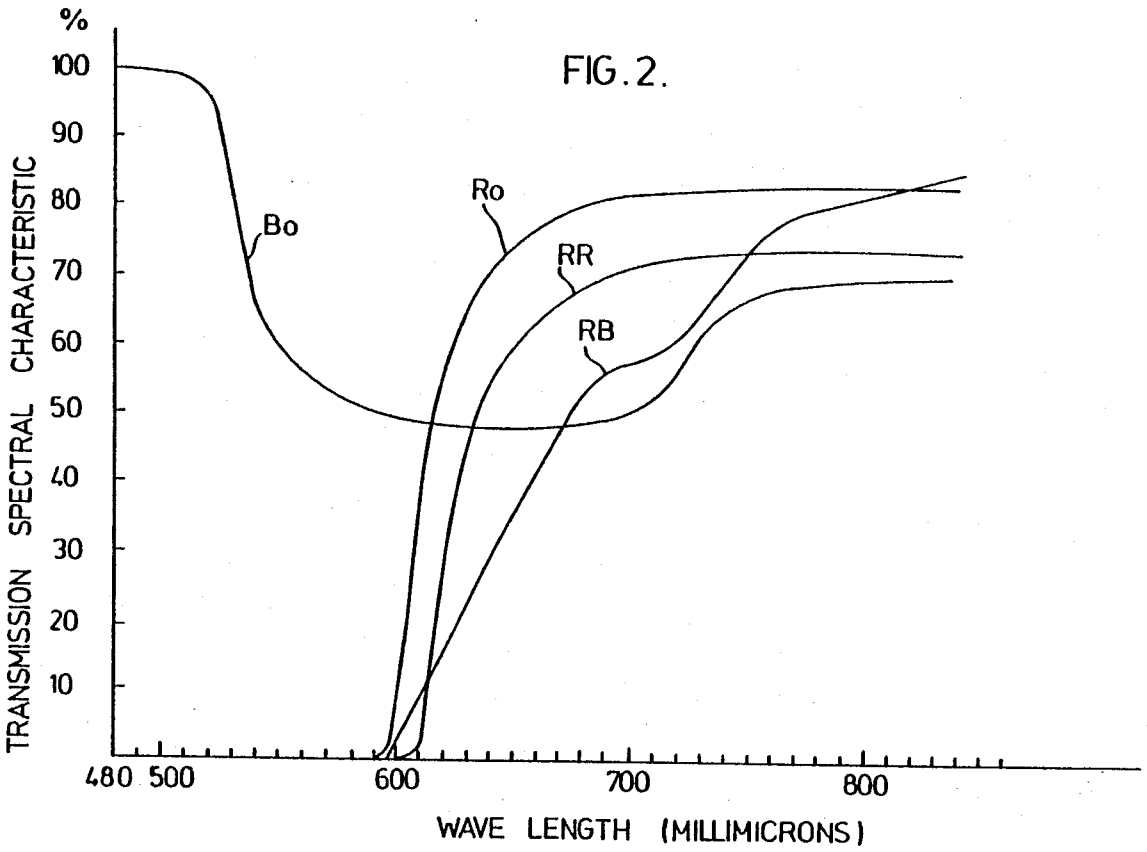
Figure 3:
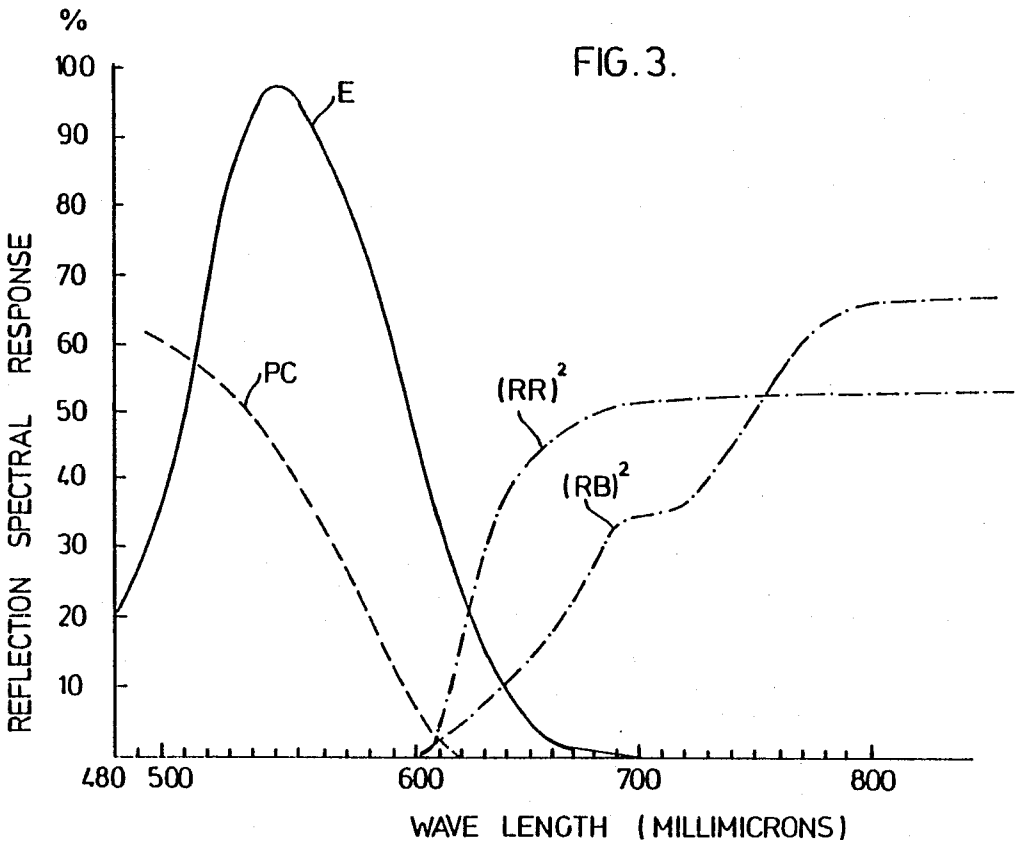

Embodiments of the invention will now be described by way of example, with reference to the accompanying drawings, of which:

FIG. 1 is a graph showing the reflection spectral response of an anti-photocopying paper in accordance with one embodiment of the invention, FIG. 2 is a graph showing the transmission spectral characteristic of transparent film layers used in other embodiments of the invention, and FIG. 3 is a graph showing the reflection spectral response of white paper to which various transparent film layers have been applied.

Referring first to FIG. 1 of the drawings, a white coated paper substrate, which may have a matte or glossy surface, has a layer of ink printed on at least one side, the colour and thickness of the ink being such as to provide a reflection or return spectral response or characteristic for vertical incident light as shown by the line F in FIG. 1. It will be noted that the reflection spectral response is substantially zero for light with a wave-length below about 620 millimicrons and is less than about 10% for light with a wave-length below about 650 millimicrons.

The standard spectral response for the human eye is shown by line E in FIG. 1, and a typical spectral response of a known photocopier is shown by the line PC. It will be noted that the spectral response of the photocopier decreases to zero at a wave-length of about 610 millimicrons. In practice, "cut-off" is the term usually applied to the wave-length at which the spectral response has fallen to about 10% and in this instance it will be seen that the cut-off wave-length of this particular photocopier is about 600 millimicrons. Thus, information (normally black) carried by the paper cannot be photocopied, since the photocopier cannot distinguish between the information and the paper colour. However, sufficient light with wave-length between about 620 millimicrons and 700 millimicrons is reflected by the paper to enable the information to be read by the human eye when the document is viewed under white light.

Three examples of ink which may be used to provide a reflection spectral response of the kind indicated by line F in FIG. 1 are as follows:

EXAMPLE 1

4.6% Process Blue
1% Reflex Blue
46.4% Transparent White
11.3% Qpaque White
20.4% Warm Red
12.3% Rubine Red
4.1% Black

EXAMPLE 2

7.5% Process Blue
1.5% Reflex Blue
38.9% Warm Red
45.3% Rubine Red
6.8% Process Black

EXAMPLE 3

Different mixtures of the following:
Rodominium Red
Rubine Red
Black

According to another embodiment of the invention, paper is provided with a reflection spectral response of the kind indicated by the line F in FIG. 1 during manufacture of the paper, for example by impregnating the original paper pulp with an appropriate ink. The ink specified in Example 1 may be used for this purpose.

Thus, an original document, which normally consists of black typed or drawing information on white paper, but which could also be comprised of any other coloured combination, may be photocopied on paper in accordance with either of the two previously described embodiments. The information on such a photocopy will be readable by the human eye, but any attempt to photocopy the photocopy will not be successful since the information will be blocked on the unauthorized photocopy.

Two previously described embodiments therefore provide an extremely novel and useful anti-photocopying paper to which confidential information may initially be applied, for example by typing, or onto which such information may be photocopied from an ordinary original white document with the information applied thereto in the usual way. In the latter case, the anti-photocopying paper in accordance with the invention replaces the paper normally used in a photocopying machine.

According to other embodiments of the invention, paper carrying information may be rendered resistant to photocopying by applying thereto a transparent coloured film which provides the paper or a relevant portion thereof with a reflection spectral response of a kind similar to the line F of FIG. 1. The film may be permanently secured to the paper if desired, such as by adhesive.

For example, a transparent film having a light transmission spectral characteristic of the kind indicated by the line Ro in FIG. 2 may be used. Such a film may be an aectate film known as Pantone ruby red. (Pantone is a trade mark of Letraset). Preferably two superposed layers of such film are used, and two such layers give a light transmission characteristic of the kind indicated by the line RR in FIG. 2, i.e. with a sharper cut-off at a longer wave-length than the single film Ro. The reflection spectral response of such a two-layer film is indicated by the line $(RR)^2$ in FIG. 3, which also shows the spectral response of the human eye by line E and of a known photocopier by the line PC. It will be noted that the spectral response of this two-layer film has a cut-off at about 625 millimicrons and is near zero at about 615 millimicrons, with a negligible overlap with the photocopier response. The human eye however will be able to read information on the document without difficulty.

To more adequately prevent photocopying, a second transparent film with a transmission spectral characteristic of about 50% in the 600 millimicron to 700 millimicron range may be used. A suitable film is a blue film sold under the name Pantone 297-A with a transmission spectral characteristic shown by the line Bo in FIG. 2. This blue film Bo is applied to the paper, with the ruby red film Ro being applied over the blue film Bo to give a combined transmission characteristic as indicated by the line RB in FIG. 2. The reflection spectral response of such a composite film is shown by the line $(RB)^2$ in FIG. 3. It will be seen that the cut-off of the composite film RB is at the higher wave-length of 655 millimicrons, compared to a wave-length of 625 millimicrons for the cut-off of composite film RR.

According to a further embodiment, the paper may advantageously be translucent, and still more advantageously transparent, a suitable paper being for example that sold by Kimberley Clark under the trade mark UV Ultra II.

The invention thus also provides anti-photocopying ink with a reflection spectral response of less than about 10% for light with a wavelength below about 600 millimicrons, preferably below about 620 millimicrons and more preferably below about 650 millimicrons.

The invention is of course applicable to any security documents, including lottery tickets, show and sports events tickets, postal and fiscal stamps, stock shares and bond certificates, credit cards, personal and bank cheques, travellers' cheques and bank notes.

Other embodiments and examples of the invention will be readily apparent to a person skilled in the art, the scope of the invention being defined in the appended claims.

We claim:

1. A document having information appearing thereon, with at least a portion of the information being located on a portion of the document which is of a colour having a reflection spectral response of less than about 10% for light with a wave-length below about 600 millimicrons and yet which is sufficiently visually contrasting with the information to enable the information to be read by the human eye when the document is viewed under white light.

2. A document according to claim 1 wherein the colour has a reflection spectral response of less than about 10% for light with a wave-length below about 620 millimicrons.

3. A document according to claim 1 wherein the colour has a reflection spectral response of less than about 10% for light with a wave-length below about 650 millimicrons.

4. A document according to claim 1 wherein the colour has a reflection spectral response of substantially zero for light with a wave-length less tha about 620 millimicrons.

5. A document according to claim 1 wherein the document comprises a paper substrate with ink of said colour applied over said portion of the document.

6. A document according to claim 5 wherein the paper substrate is white and the information is black.

7. A document according to claim 1 wherein the document comprises paper coloured during manufacture to provide said colour to said portion of the document.

8. A document according to claim 7 wherein the information is black.

9. A document according to claim 1 wherein the document comprises a paper substrate with the information appearing thereon, and a transparent film of said colour is secured to the paper substrate over said portion of the document.

10. A document according to claim 9 wherein the transparent film comprises a plurality of superposed layers.

11. A document according to claim 10 wherein the transparent film comprises a first layer with a transmission spectral response which is less than about 10% at a wave-length at about 600 millimicrons and rises to about 75% at a wave-length of about 650 millimicrons, and a second layer with a transmission spectral response of about 50% for wave-length from about 600 to about 700 millimicrons, the first and second layers providing a reflection spectral response of less than about 10% for light with a wave-length less than about 600 millimicrons.

12. A document according to claim 9 wherein the paper is white and the information is black.

13. A method of rendering a document with information thereon resistant to photocopying, said method comprising providing a portion of the document carrying at least a portion of the information with a colour having a reflection spectral response of less than about 10% for light with a wave-length below about 600 millimicrons and yet which is sufficiently contrasting with the information to enable the information to be read by the human eye when the document is viewed under white light.

14. A method according to claim 13 wherein the colour has a reflection spectral response of less than about 10% for light with a wave-length below about 620 millimicrons.

15. A method according to claim 13 wherein the colour has a reflection spectral response of less than about 10% for light with a wave-length below about 650 millimicrons.

16. A method according to claim 13 wherein the reflection spectral response of said colour is substantially zero for light with a wave-length less than about 620 millimicrons.

17. A method according to claim 13 wherein said portion of the document is provided with said colour by applying an ink of said colour over said portion of the document.

18. A method according to claim 17 wherein the paper is white and the information is black.

19. A method according to claim 13 wherein said portion of the document is provided with said colour during manufacture of the paper.

20. A method according to claim 19 wherein the information is black.

21. A method according to claim 13 wherein said portion of the document is provided with said colour by laying a transparent film of said colour over said portion of the document.

22. A method according to claim 21 wherein the transparent film of said colour over said portion of the document.

23. A method according to claim 21 wherein the transparent film comprises a plurality of superposed layers.

24. A method according to claim 23 wherein the transparent film comprises a first layer with a transmission spectral response which is less than about 10% at a wave-length at about 600 millimicrons and rises to about 75% at a wave-length of about 650 millimicrons, and a second layer with transmission spectral response of about 50% for wave-length from about 600 to about 700 millimicrons, the first and second layers providing a reflection spectral response of less than about 10% for light with a wave-length less than about 650 millimicrons.

25. Anti-photocopying paper having a colour with a reflection spectral response of less than about 10% for light with a wave-length below about 600 millimicrons and yet which is sufficiently visually contrasting with information, when said information is typed thereon or otherwise applied thereto, to enable said information to be read by the human eye when the paper is viewed under white light.

26. Anti-photocopying paper according to claim 25 wherein said colour has a reflection spectral response of less than about 10% for light with a wave-length below about 620 millimicrons.

27. Anti-photocopying paper according to claim 25 wherein the colour has a reflection spectral response of less than about 10% for light with a wave-length below about 650 millimicrons.

28. Anti-photocopying paper according to claim 25 wherein the colour has a reflection spectral response of substantially zero for light with a wave-length less than about 620 millimicrons.

29. Anti-photocopying paper according to claim 25 comprising a white paper substrate to which ink of said colour has been applied.

30. Anti-photocopying paper according to claim 25 to which said colour has been applied during manufacture.

31. Anti-photocopying paper according to claim 25 comprising a white paper substrate to which a transparent film of said colour has been applied.

32. Anti-photocopying paper according to claim 31 wherein the transparent film comprises a plurality of superposed layers.

33. Anti-photocopying paper according to claim 32 wherein the transparent film comprises a first layer with a transmission spectral response which is less than about 10% at a wave-length at about 600 millimicrons and rises to about 75% at a wave-length of about 650 millimicrons, and a second layer with a transmission spectral response of about 50% for wave-length of about 650 millimicrons, and a second layer with a transmission spectral response of about 50% for wavelength from about 600 to about 700 millimicrons, the first and second layers providing a reflection spectral response of less than about 10% for light with a wavelength less than about 650 millimicrons.

* * * * *